United States Patent [19]

Zeugin et al.

[11] Patent Number: 4,735,076

[45] Date of Patent: Apr. 5, 1988

[54] PROCESS FOR THE PRODUCTION OF A CONICAL SHELL USING SHEET METAL BENDING ROLLS

[75] Inventors: Hans Zeugin, Dornach, Switzerland; Heinz Ludwig, D-Wyhlen, Fed. Rep. of Germany

[73] Assignee: Chr. Haeusler AG, Guggingen, Switzerland

[21] Appl. No.: 873,094

[22] Filed: Jun. 4, 1986

[30] Foreign Application Priority Data

Jun. 4, 1985 [CH] Switzerland ..... 2356/85

[51] Int. Cl.[4] ..... B21D 51/10; B21D 43/09

[52] U.S. Cl. ..... 72/307; 72/386; 72/368; 72/420

[58] Field of Search ..... 72/166–175, 72/420, 389, 386, 384, 212, 307, 368

[56] References Cited

U.S. PATENT DOCUMENTS

| | | | |
|---|---|---|---|
| 2,674,294 | 4/1954 | Ekberg | 72/171 |
| 3,016,082 | 1/1962 | Miller | 72/175 |
| 3,091,279 | 5/1963 | O'Neill . | |
| 3,459,020 | 8/1969 | Morita et al. | 72/174 |
| 3,505,852 | 4/1970 | Sassak | 72/386 |
| 3,623,349 | 11/1971 | Hausler | 72/171 |
| 4,195,509 | 4/1980 | Herburg | 72/167 |
| 4,312,208 | 1/1982 | Schafer | 72/166 |

FOREIGN PATENT DOCUMENTS 534391 9/1931 Fed. Rep. of Germany .

*Primary Examiner*—Daniel C. Crane
*Attorney, Agent, or Firm*—Spencer & Frank

[57] ABSTRACT

A method of producing a conical shell from a metal sheet cut to size. The method includes feeding the sheet in a nip between two transport rollers an incremental distance between respective positions in which nonparallel straight line generatrices on the sheet defining the shell to be produced are in an aligned with the nip, translating a bending roller into engagement with the sheet to incrementally bend the sheet in a direction perpendicular to the generatrix between the nip, then retracting the bending roller away from the sheet, and successively repeating the above steps until the sheet is in the shape of the conical shell to be produced.

4 Claims, 1 Drawing Sheet

PROCESS FOR THE PRODUCTION OF A CONICAL SHELL USING SHEET METAL BENDING ROLLS

FIELD OF THE INVENTION

The invention relates to a process for the production of a conical shell by means of sheet metal bending rolls from a metal sheet which has been cut to size, the workpiece to be processed being fed and rotated between the upper roll and the lower roll so that bending can always take place at right angles to the generatrix.

PRIOR ART

To produce cones from metal sheets cut to size, 3-roll machines or 4-roll machines are used which shape the cut sheet, which possesses two arc-shaped edges, which are opposite one another and of different lengths, into the cone in one pass or in several passes. Since, in the case of a cone, the generatrices are not parallel to one another, the sheet must not be passed along a straight path through the machines; instead, its direction must be altered continuously so that the generatrices are always parallel to the axes of the rolls, or (which is equivalent) so that that point of each curved edge which is located between the transport rolls always indicates the direction of feed. For this purpose, the conventional sheet metal bending rolls have a brake shoe which is adjacent to the shorter of the two curved edges and brakes it so that the change in direction is ensured. However, this method of sheet metal shaping has the substantial disadvantage that the brake shoe exerts great forces on the workpiece, so that it is possible for the arc-shaped edge to be compressed. This is particularly inappropriate if it is to be formed into a somewhat sharp welding edge prior to bending, because an edge weakened in this manner always gives way under the compressive forces, so that the edge in question cannot be prepared as a welding edge prior to bending.

SUMMARY OF THE INVENTION

In the process according to the present invention, it is possible to manage without a brake shoe which causes compression of the edge, since, in the process, feed is effected stepwise and, between each feed step, a bending roll is lifted to effect bending and then removed from the workpiece again.

In this process, in which feeding and bending are carried out in small, separate, successive steps, it is possible to keep the forces acting on the workpiece edge so small that they do not damage this edge even when it is already in the form of a welding edge. This can be achieved essentially by a procedure in which the rolls used as feed rolls for transporting the workpiece are adjusted so that the nip opens to one side and hence the workpiece is clamped only in a relatively narrow area at the longer of the two arc-shaped edges, so that it is not held firmly in the remaining region and can rotate relatively easily. Rotation can be effected using a brake shoe whose friction surface is shaped to match the shape of the edge of the workpiece. However, it is more advantageous to use a controllable clamping apparatus which clamps the workpiece at the shorter of the two arc-shaped edges during certain intervals or prevents its transport. After each feed step, the two transport rolls are reset to the original position in which they run parallel to one another and hold the workpiece along the entire generatrix so that the workpiece is not transported during the subsequent bending operation.

BRIEF DESCRIPTION OF THE DRAWINGS

Embodiments of the invention are described below with reference to the drawing.

DETAILED DESCRIPTION

Figure 1:
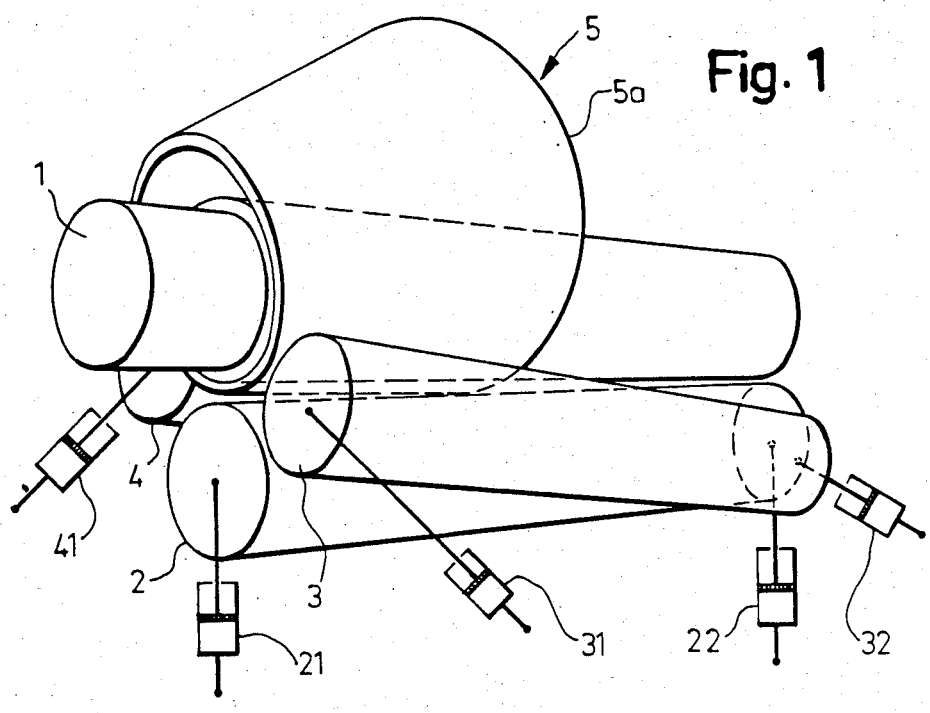
FIG. 1 shows, completely schematically, a perspective view of a 4-roll bending machine with a processed workpiece.
Figure 2:
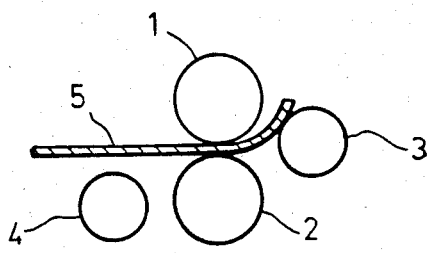
FIG. 2 shows schematically a cross section through the machine shortly after the beginning of the shaping process.

In the drawing, reference numeral 1 denotes the upper roll, reference numeral 2 denotes the lower roll and, reference numeral 3 and 4 denote the two side rolls reference numeral. 5 denotes the workpiece, in this case the processed conical shell. The bearings of the individual rolls are not shown, but it is known that the upper roll should be mounted so that one of its bearings can be swung downward to allow the processed workpiece to be removed from the machine.

The hydraulic cylinders which are used for transporting the roll bearings are shown schematically and as if they were effective at the geometric axes of the rolls. The hydraulic cylinders of the lower roll are denoted by 21 and 22, while those of the side rolls are denoted by 31 and 32, and 41. The second cylinder belonging to the side roll 4 is not visible in the drawing. The drive structure of the upper roll and of the lower roll are also not shown in the drawing.

The workpiece used is a metal sheet cut to size for producing a cone. If a right cone is to be produced, this sheet possesses two concentric, arc-shaped edges and two straight edges which connect these edges and whose extensions intersect at the center of the circles corresponding to the arc-shaped edges. If an oblique cone or a cone having a non-circular cross-section is to be produced, the workpiece naturally has a somewhat different shape, which is know per se.

The workpiece 5 is inserted in a conventional manner into the sheet metal bending rolls and is held between the upper roll 1 and the lowre roll 2, along the entire length of the workpiece. Its free edge is then bent by advancing the side roll 3 which serves as the bending roll. The side roll 3 is then removed from the workpiece 5 again, and the lower roll 2 is swivelled so that the nip opens toward the hydraulic cylinder 21, as can be seen in FIG. 1, where only the longer arc-shaped edge 5*a* of the workpiece 5 is tightly clamped between the two rolls 1 and 2. The workpiece is then transported a very small distance by rotating the rolls. A brake shoe, which is not shown, or a controllable clamping apparatus produces a rotation of the workpiece so that the generatrices of the workpiece which are to be generated are located between the two transport rolls 1 and 2. In addition to the brake shoe, it is also possible to use a graduated roll or an optical scanning apparatus which measures the advance at the shorter of the two arc-shaped edges. A computer can be used to compare the size of this advance with the advance of the longer arc-shaped edge effected by rotation of the rolls. If the ratio determined in this manner does not correspond to the ratio of the lengths of the two arc-shaped edges which has been input into the computer, the angle of opening of the gap between the rolls is altered or the clamping apparatus is actuated in order to obtain the correct ratio of advance to rotation. Computers of this type which give control commands when the measured values deviate from an input set-point value are known per se and will therefore not be described in more detail here.

It is also possible to draw on the workpiece generatrices or the ends of generatrices of the conical shell to be produced and to provide the computer with an optical scanning apparatus which gives the computer the necessary information to permit it to control the transport rolls and the clamping apparatus so that the workpiece is advanced stepwise, and at the same time rotated, between two bending operations, so that each of the bending operations takes place at a generatrix which has been drawn. After each feed step, the transport rolls are returned to their starting position, in which they are arranged with their axes parallel, so that the workpiece is held uniformly along its entire length, and the movement of the lateral bending roll 3 which produces the curvature of the workpiece does not result in the workpiece being fed between the rolls 1 and 2. The bending step is followed by a movement of the transport rolls and a transport step, which is again followed by a bending step.

This process could be of course be carried out by manual control of the machine. However, it is substantially more advantageous if a programmed control into which only the parameters need be input is used for this purpose.

We claim:

1. A method of producing a conical shell from a metal sheet cut to size having two opposite arc-shaped edges of differential lengths, the method comprising the steps of:

feeding the sheet in a direction generally along the arc-shaped edges in a nip between two transport rollers an incremental distance between respective positions in which respective ones of nonparalle straight line generatrices on the sheet defining the shape of the conical shell to be produced are in and aligned with the nip;

after said step of feeding, translating a bending roller into engagement with the sheet to incrementally bend the sheet in a direction perpendicular to the generatrix in the nip;

after said step of translating the bending roller to incrementally bend the sheet, retracting the bending roller away from the sheet; and successively repeating said steps of feeding, translating the bending roller to incrementally bend the sheet, and retracting until the sheet is in the shape of the conical shell to be produced.

2. A method as in claim 1, further comprising the steps of measuring the displacement of each of the two arc-shaped edges during said step of feeding, and controlling the feeding at the two arc-shaped edges with the use of the measured displacements of the two arc-shaped edges during the step of feeding.

3. A method as in claim 1, further comprising the steps of adjusting at least one of the two transport rollers before the step of feeding so that the nip is larger at the shorter of the arc-shaped edges of the sheet than at the longer of the arc-shaped edges, and adjusting the at least one of the transport rollers after the step of feeding so that the two transport rollers are parallel to each other and hold the sheet firmly therebetween during the step of translating the bending roller to incrementally bend the sheet, said step of feeding including the step of rotating at least one of the transport rollers in engagement with the longer of the arc-shaped edges while incrementally drawing the sheet through the nip.

4. A method as in claim 3, further comprising the steps of measuring the displacement of each of the two arc-shaped edges during said step of feeding and controlling the feeding of the two arc-shaped edges with the use of the measured displacements of the two arc-shaped edges during the step of feeding, said step of controlling including the step of engaging the shorter edge during the step of feeding, to incrementally swivel the sheet.

* * * * *